US006062538A

United States Patent [19]

Nien

[11] Patent Number: 6,062,538

[45] Date of Patent: May 16, 2000

[54] GAS VALVE SEAT

[76] Inventor: Chen Chiun Nien, 4F-1, No. 26, Lane 56, Wun Chan Tong Seven Str., Taichung City, Taiwan

[21] Appl. No.: 09/119,761

[22] Filed: Jul. 21, 1998

[51] Int. Cl.[7] ..... F16K 5/20

[52] U.S. Cl. ..... 251/174; 251/315.14

[58] Field of Search ..... 251/174, 315.14

[56] References Cited

U.S. PATENT DOCUMENTS 1,331,025 2/1920 Riggin ..... 251/315.14

2,973,182 2/1961 Gill ..... 251/315.14

3,469,818 9/1969 Cowan ..... 251/174

5,562,116 10/1996 Henwood ..... 137/15

*Primary Examiner*—John Fox

*Attorney, Agent, or Firm*—Charles E. Baxley, Esq.

[57] ABSTRACT

A gas valve seat is provided with a control chamber in which a control device is disposed. The control device includes a valve body, a fitting ring, an elastic element, and a rotary plug. The valve body is urged by the elastic element to locate securely between the fitting ring and the rotary plug such that the wear of the valve body is effectively minimized.

6 Claims, 8 Drawing Sheets

GAS VALVE SEAT

FIELD OF THE INVENTION

The present invention relates generally to a valve seat, and more particularly to a gas valve seat.

BACKGROUND OF THE INVENTION

As shown in FIGS. 1–3, a gas valve seat of the prior art consists of a switch valve body 2 which is provided therein with a control chamber 24 which is in turn provided therein with a valve body 27, and two plug rings 25 and 26. The valve body 27 and the two plug rings 25 and 26 are forced by a fitting tube 3 to locate hermetically in the control chamber 24.

Such a prior art gas valve seat as described above is defective in design in that the valve body 27 is often not in an intimate contact with the plug rings 25 and 26, thereby resulting in the formation of small gaps 28, as shown in FIGS. 2 and 3. The gaps 28 are often responsible for a gas leak. In addition, the formation of the gaps 28 can result from the wear of the valve body 27 as well as the plug rings 25 and 26. Moreover, the wear of the valve body 27 or the plug rings 25 and 26 can be compounded under the circumstance that the fitting tube 3 is not securely fastened with the switch valve body 2, thereby intensifying the wear of the valve body 27 or the plug rings 25 and 26 at the time when the pilot knob 11 is turned.

SUMMARY OF THE INVENTION

The primary objective of the present invention is therefore to provide an improved gas valve seat free from the drawbacks of the prior art gas valve seat described above.

In keeping with the principle of the present invention, the foregoing objective of the present invention is attained by the gas valve seat having a control chamber in which a valve body is located such that the valve body is always urged by an elastic element to locate securely between a fitting ring and a rotary plug, thereby minimizing the wear of the valve body to prevent the gas leak.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
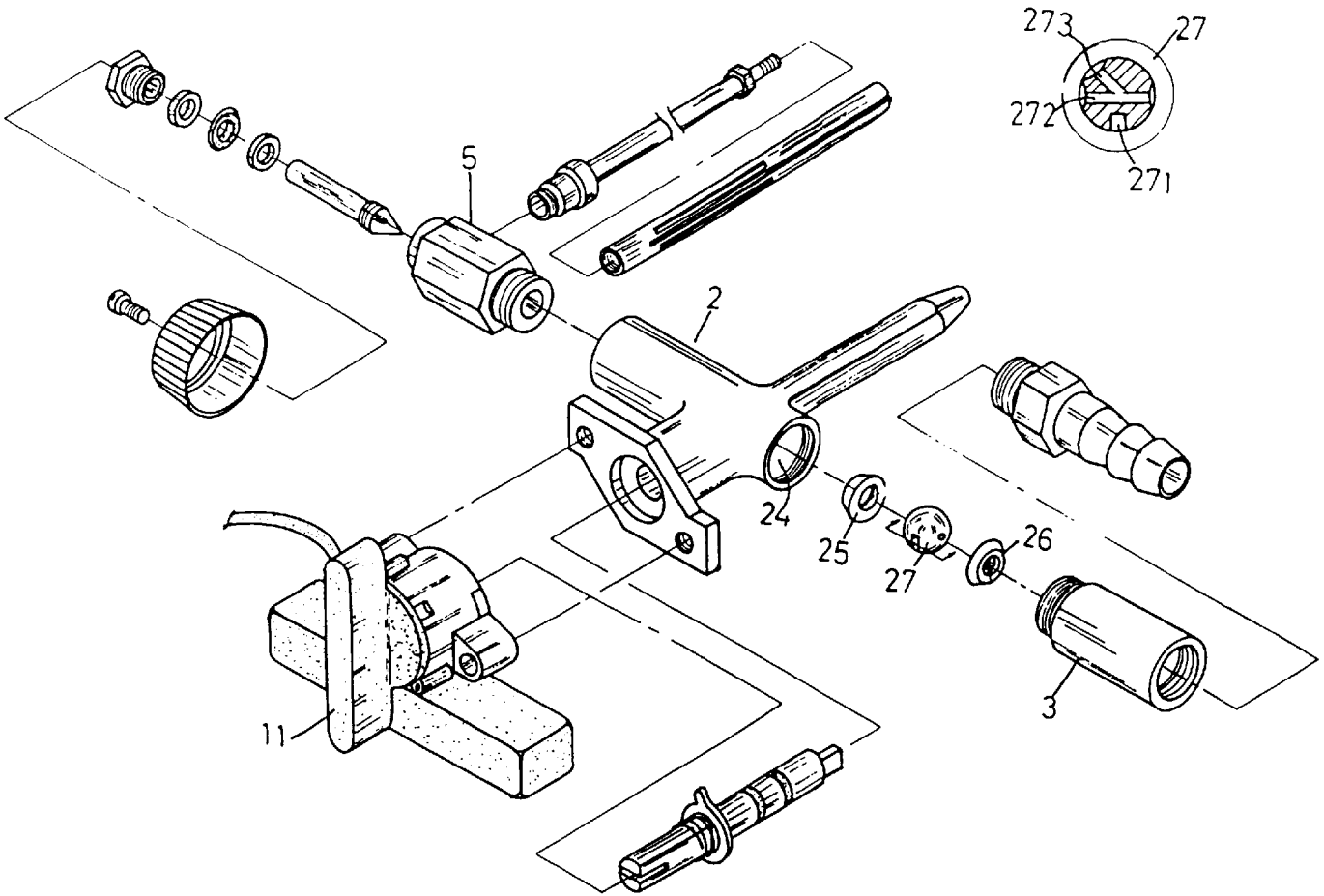
FIG.1 PRIOR ART
FIG. 1 shows an exploded view of a gas valve seat of the prior art.
Figure 2:
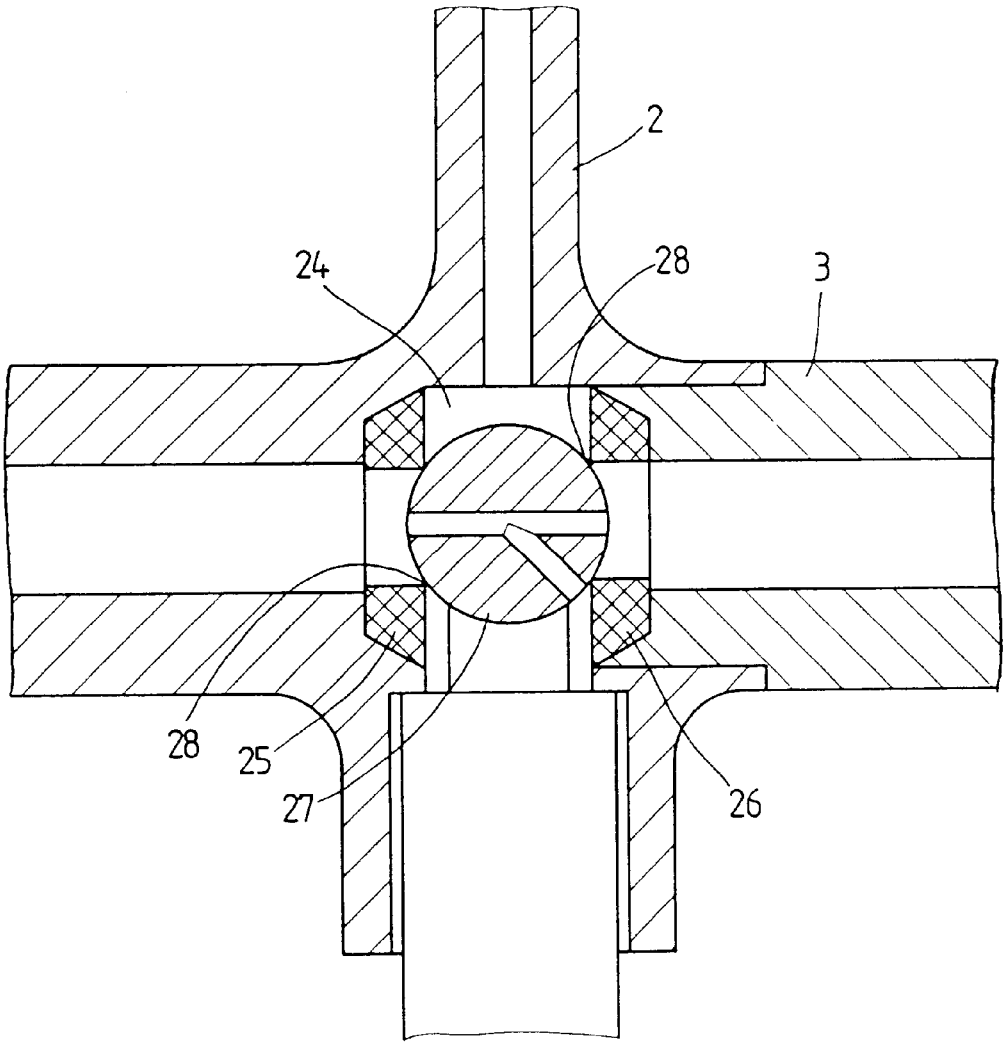
FIG. 2 PRIOR ART
FIG. 2 shows a sectional schematic view of the gas valve seat of the prior art.
Figure 3:
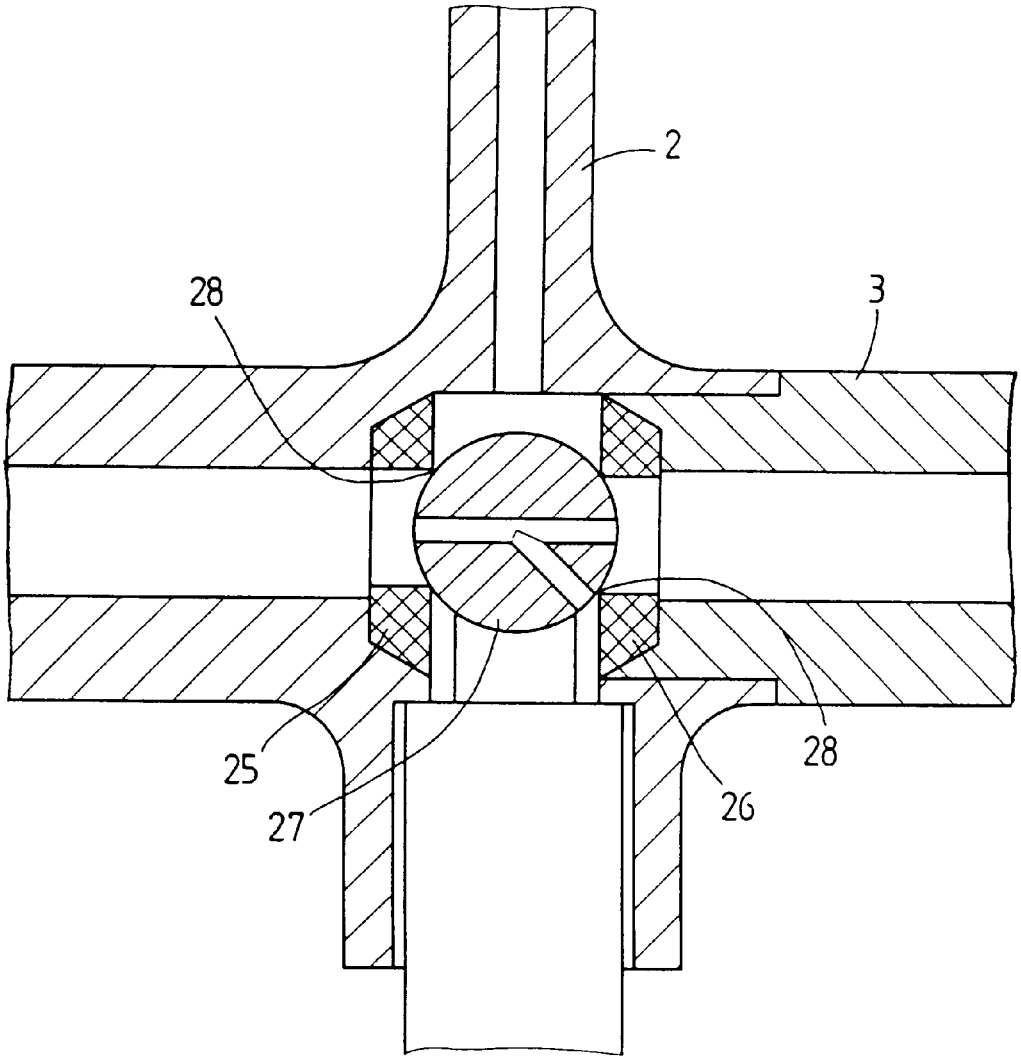
FIG.3 PRIOR ART
FIG. 3 shows another sectional schematic view of the gas valve seat of the prior art.
Figure 4:
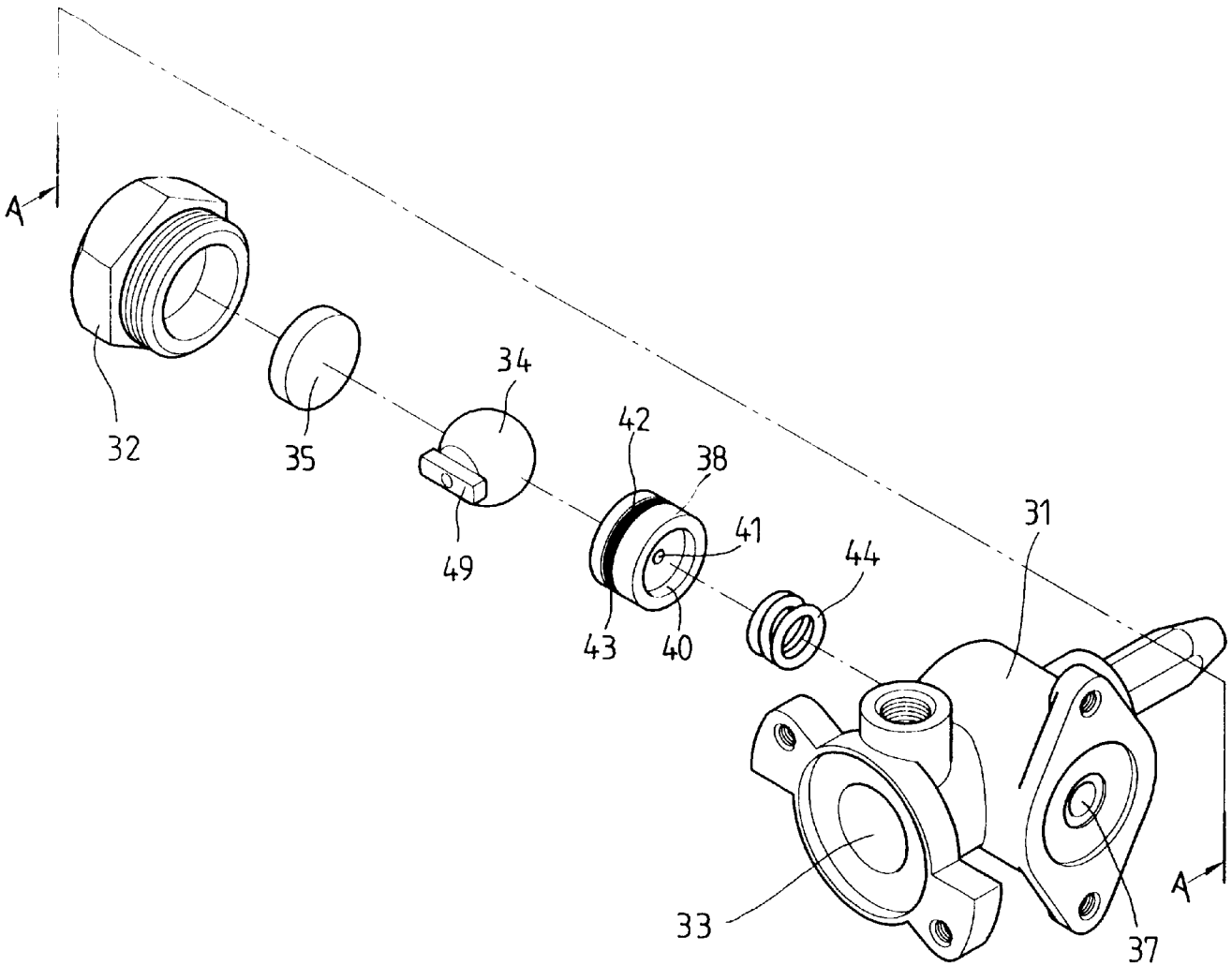
FIG. 4 shows an exploded view of a gas valve seat of the present invention.
Figure 5:
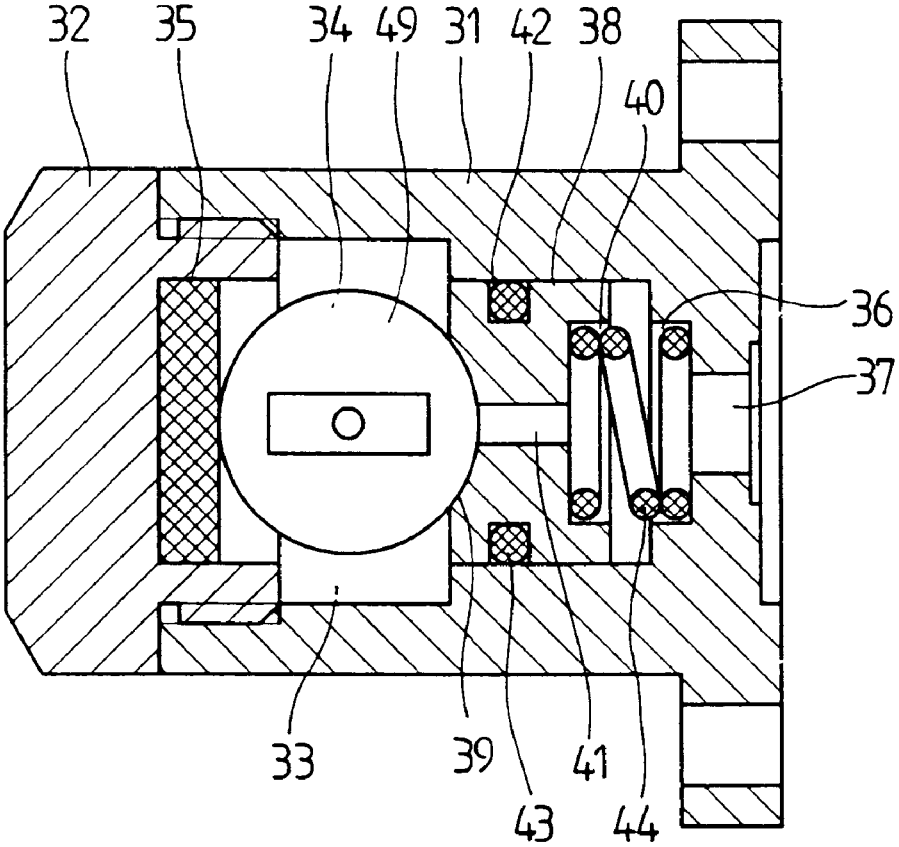
FIG. 5 shows a sectional view of the gas valve seat of the present invention in combination.

As shown in FIGS. 4 and 5, a gas valve seat 31 embodied in the present invention is composed of a control chamber 33 provided in the inner wall thereof with a retaining slot 36. The gas valve seat 31 is further composed of a gas inlet 37 in communication with the control chamber 33, and of a control device which is located in the control chamber 33 and is composed of an elastic element 44, a fitting ring 38, a valve body 34, a stop piece 35, and a rotary plug 32.

The fitting ring 38 is provided in the outer wall thereof with a circular groove 42 in which a washer 43 is received. The fitting ring 38 is further provided in the inner wall of one end thereof with an arcuate cut 39, and in the inner wall of another end thereof with a retaining slot 40 in which one end of the elastic element 44 is retained such that another end of the elastic element 44 is retained in the retaining slot 36 of the control chamber 33.

The valve body 34 is provided with a valve handle 49 fastened therewith such that the valve handle 49 is engaged with a switch (not shown in the drawing). The valve body 34 is located between the fitting ring 38 and the stop piece 35 which is fitted into an open end of the rotary plug 32. The open end of the rotary plug 32 is provided with an outer threaded portion which is engaged with an inner threaded portion of the control chamber 33 of the gas valve seat 31.

The elastic element 44 serves to provide the control device with an elastic force to push the fitting ring 38 against the valve body 34, which is in turn stopped by the stop piece 35 of the rotary plug 32 such that the valve body 34 is capable of self-adjusting its position in relation to the arcuate cut 39 of the fitting ring 38. As a result, the valve body 34 is hermetically located between the stop piece 35 and the fitting ring 38.

Figure 6:
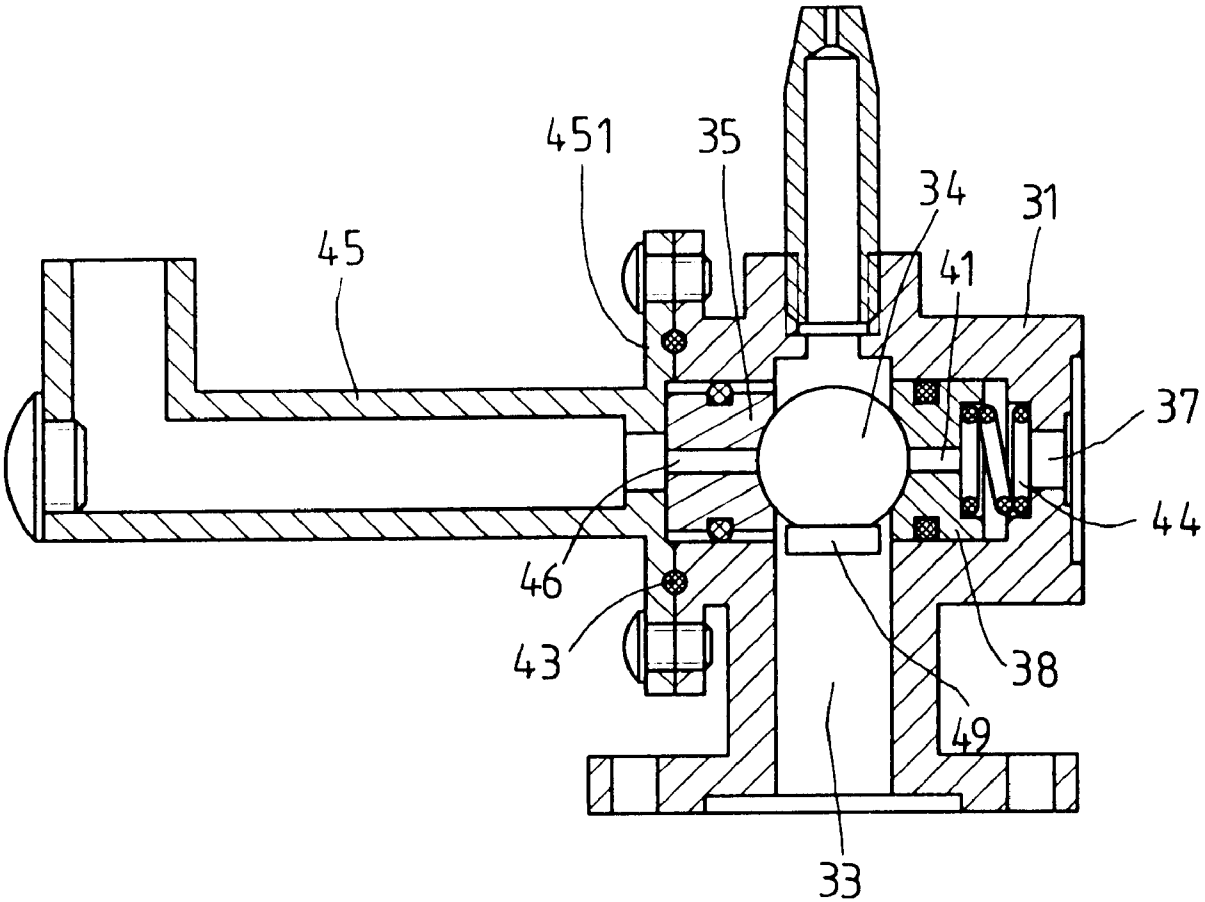
FIG. 6 shows a schematic view of the present invention in operation.

As shown in FIG. 6, the rotary plug 32 may be replaced by a connection tube 45 of a hollow construction and having a flange 451. The flange 451 is provided with a circular slot (not shown in the drawing) for receiving the washer 43. In addition, the stop piece 35 is provided in the center thereof with a through hole 46 via which gas can flow into the hollow connection tube 45.

Figure 7:
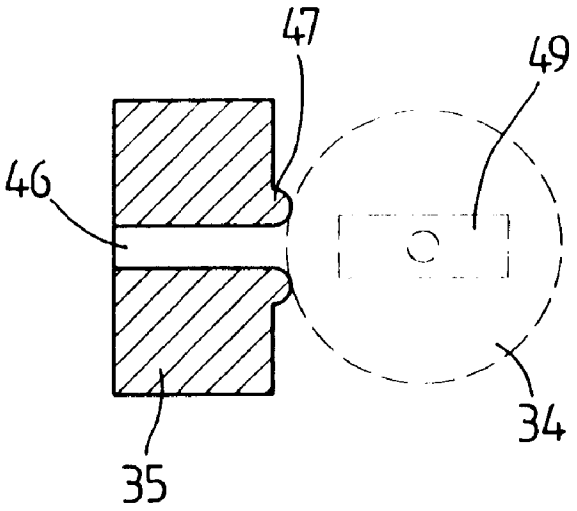
FIG. 7 shows a schematic view of a stop piece of the present invention.
Figure 8:
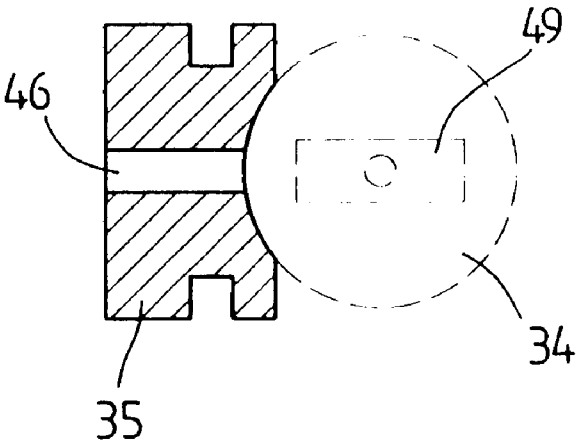
FIG. 8 shows a schematic view of a modified stop piece of the present invention.

As shown in FIGS. 7 and 8, the stop piece 35 has a contact surface 47 which is in contact with the valve body 34. The contact surface 47 may be provided with two protrusions as shown in FIG. 7, or with an arcuate recess as shown in FIG. 8.

Figure 9:
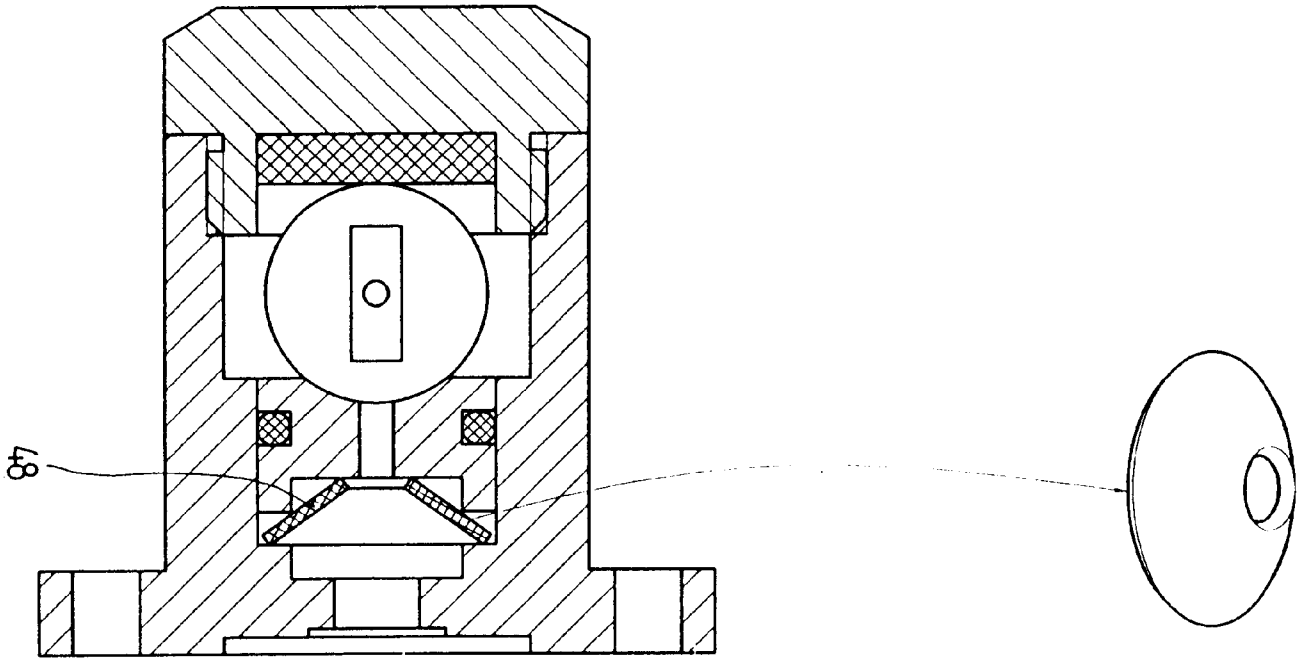
FIG. 9 shows a schematic view of a modified elastic element of the present invention.

The elastic element 44 is a coil spring. However, the coil spring 44 may be replaced by a tapered elastomer 48, as shown in FIG. 9.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

What is claimed is:

1. A gas valve seat comprising:

a control chamber;

a gas inlet in communication with said control chamber; and a control device disposed in said control chamber;

wherein said control chamber is provided in an inner wall of one end thereof with a retaining slot, and in an inner wall of another end thereof with an inner threaded portion;

wherein said control device comprises:

a fitting ring provided in an outer wall thereof with a circular groove for locating a washer, said fitting ring further provided in an inner wall of one end thereof with an arcuate cut and in an inner wall of another end thereof with a retaining slot;

an elastic element located in said control chamber such that one end of said elastic element is retained in said retaining slot of said control chamber, and that another end of said elastic element is retained in said retaining slot of said fitting ring;

a rotary plug provided in one end thereof with a stop piece fitted thereinto, said rotary plug further provided in an outer surface of said one end thereof with an outer threaded portion, said rotary plug fastened with said control chamber such that said outer threaded portion is engaged with said inner threaded portion of said control chamber; and a valve body located between said fitting ring and said stop piece of said rotary plug such that said valve body can be pushed by an elastic force of said elastic element via said fitting ring against said stop piece in a manner that said valve body is located hermetically between said stop piece of said rotary plug and said fitting ring.

2. The gas valve seat as defined in claim 1, wherein said valve body is provided with a valve handle fastened therewith such that said valve handle is engaged with a switch.

3. The gas valve seat as defined in claim 1, wherein said elastic element is a coil spring.

4. The gas valve seat as defined in claim 1, wherein said elastic element is an elastomer.

5. The gas valve seat as defined in claim 1, wherein said stop piece has a contact surface in contact with said valve body, said contact surface provided with two protrusions.

6. The gas valve seat as defined in claim 1, wherein said stop piece has a contact surface which is provided with an arcuate recess in contact with said valve body.

* * * * *